US011141666B2

(12) United States Patent
Chutter et al.

(10) Patent No.: US 11,141,666 B2
(45) Date of Patent: Oct. 12, 2021

(54) LOOPING SAUCER AMUSEMENT ATTRACTION AND METHOD FOR MAKING THE SAME

(71) Applicant: WHITEWATER WEST INDUSTRIES, LTD., Richmond (CA)

(72) Inventors: Geoff Chutter, Richmond (CA); Rick Briggs, Richmond (CA); Claudio Barrera, Richmond (CA); Andrey Khomovskiy, Richmond (CA); Bruce Bradley, Richmond (CA)

(73) Assignee: WHITEWATER WEST INDUSTRIES, LTD.

( * ) Notice: Subject to any disclaimer, the term of this patent is extended or adjusted under 35 U.S.C. 154(b) by 0 days.

(21) Appl. No.: 16/619,894

(22) PCT Filed: Jun. 8, 2018

(86) PCT No.: PCT/IB2018/000761
§ 371 (c)(1),
(2) Date: Dec. 5, 2019

(87) PCT Pub. No.: WO2018/224888
PCT Pub. Date: Dec. 13, 2018

(65) Prior Publication Data

US 2020/0222818 A1 Jul. 16, 2020

Related U.S. Application Data

(63) Continuation of application No. 29/625,616, filed on Nov. 10, 2017, now Pat. No. Des. 855,136.
(Continued)

(51) Int. Cl.

| | |
|---|---|
| ***A63G 21/18*** | (2006.01) |
| ***A63G 31/00*** | (2006.01) |
| *A63G 21/10* | (2006.01) |

(52) U.S. Cl.
CPC ..... *A63G 21/18* (2013.01); *A63G 31/007* (2013.01); *A63G 21/10* (2013.01)

(58) Field of Classification Search
CPC ..... A63G 3/00; A63G 21/00; A63G 21/02; A63G 21/10; A63G 21/14; A63G 21/18; A63G 31/007
(Continued)

(56) References Cited

U.S. PATENT DOCUMENTS

| | | |
|---|---|---|
| 419,860 A | 1/1890 | Libbey |
| 654,980 A | 7/1900 | Howard |

(Continued)

FOREIGN PATENT DOCUMENTS

| | | |
|---|---|---|
| CA | 290878 | 3/1992 |
| CA | 2328339 | 12/2001 |

(Continued)

OTHER PUBLICATIONS

Written Opinion of the International Searching Authority for PCT/IB2018/000761, dated Dec. 5, 2018.

*Primary Examiner* — Kien T Nguyen
(74) *Attorney, Agent, or Firm* — Kari L. Barnes; Buchalter, a professional corporation

(57) ABSTRACT

A waterslide feature for providing a looping travel path for a rider traveling thereon and method for making the same. The waterslide feature may be in the shape of a tilted bowl or saucer that provides a 360 degree travel path for a rider around the waterslide feature. The rider may experience a feeling of weightlessness at one or more locations (e.g., art apex) of the travel path. The rider may be provided into the tilted bowl by way of an entrance (e.g., flume) and may be received from the tilted bowl by way of an exit (e.g., flume). The orientation of the entrance and exit may be in any of a variety of configurations, such as side-by-side or over-under.
(Continued)

Colored fiberglass, lighting dements, and other features may be included to enhance the visual or other impact of the waterslide feature to riders and/or spectators.

16 Claims, 17 Drawing Sheets

Related U.S. Application Data

(60) Provisional application No. 62/517,053, filed on Jun. 8, 2017.

(58) Field of Classification Search
USPC ..... 472/13, 118, 128, 129; 104/55, 69, 70
See application file for complete search history.

(56) References Cited

U.S. PATENT DOCUMENTS

| | | | |
|---|---|---|---|
| 728,246 | A | 5/1903 | Kremer |
| 803,119 | A | 10/1905 | Logan |
| 920,567 | A | 5/1909 | Hayes |
| 953,266 | A | 3/1910 | Healy |
| 1,511,139 | A | 10/1924 | Leo-Roziger |
| 1,520,217 | A | 12/1924 | Auperl |
| 1,577,689 | A | 3/1926 | Capitelli |
| 1,648,196 | A | 11/1927 | Rohmer |
| 1,655,498 | A | 1/1928 | Fisch |
| 1,745,241 | A | 1/1930 | Bartlett |
| 2,224,948 | A | 12/1940 | Bloomquist |
| 2,254,482 | A | 9/1941 | Heller |
| 2,724,123 | A | 11/1955 | Kesler |
| D210,298 | S | 2/1968 | Moulton |
| D213,271 | S | 1/1969 | Gale |
| D218,625 | S | 9/1970 | Ahrens |
| D221,963 | S | 9/1971 | Henning |
| D226,933 | S | 5/1973 | Wormser |
| D227,382 | S | 6/1973 | Wormser |
| 3,755,878 | A | 9/1973 | Henning |
| 3,830,161 | A | 8/1974 | Bacon |
| 3,853,067 | A | 12/1974 | Bacon |
| 3,923,301 | A | 12/1975 | Myers |
| 4,129,916 | A | 12/1978 | Schlesinger |
| 4,149,710 | A | 4/1979 | Rouchard |
| 4,172,593 | A | 10/1979 | Palakanis |
| D253,363 | S | 11/1979 | Dieter |
| 4,192,499 | A | 3/1980 | Groves |
| 4,194,733 | A | 3/1980 | Whitehouse |
| 4,196,900 | A | 4/1980 | Becker |
| D256,827 | S | 9/1980 | Allen |
| D256,828 | S | 9/1980 | Allen |
| D256,940 | S | 9/1980 | Allen |
| D257,874 | S | 1/1981 | Sheehan |
| 4,278,247 | A | 7/1981 | Joppe |
| D262,230 | S | 12/1981 | Ament |
| 4,339,122 | A | 7/1982 | Croul |
| D266,346 | S | 9/1982 | Millay |
| D268,859 | S | 5/1983 | Ament |
| D269,104 | S | 5/1983 | Brown |
| D269,105 | S | 5/1983 | Brown |
| D269,106 | S | 5/1983 | Brown |
| D269,107 | S | 5/1983 | Brown |
| 4,392,434 | A | 7/1983 | Dürwald |
| 4,394,173 | A | 7/1983 | Aste |
| 4,429,867 | A | 2/1984 | Barber |
| 4,444,290 | A | 4/1984 | Valerio |
| 4,484,739 | A | 11/1984 | Kreinbihl |
| 4,652,199 | A | 3/1987 | Pole |
| 4,738,590 | A | 4/1988 | Butler |
| 4,750,733 | A | 6/1988 | Foth |
| 4,790,531 | A | 12/1988 | Matsui |
| 4,805,896 | A | 2/1989 | Moody |
| 4,805,897 | A | 2/1989 | Dubeta |
| 4,836,521 | A | 6/1989 | Barber |
| 4,893,447 | A | 1/1990 | Opp |
| 4,905,326 | A | 3/1990 | Nakamura |
| 4,910,814 | A | 3/1990 | Weiner |
| 4,971,314 | A | 11/1990 | Barber |
| 5,011,134 | A | 4/1991 | Langford |
| 5,069,443 | A | 12/1991 | Shiratori |
| 5,137,497 | A | 8/1992 | Dubeta |
| 5,171,101 | A | 12/1992 | Sauerbier |
| D335,517 | S | 5/1993 | Vatterot |
| 5,236,280 | A | 8/1993 | Lochtefeld |
| 5,271,592 | A | 12/1993 | Lochtefeld |
| D344,317 | S | 2/1994 | Petersheim |
| 5,326,328 | A | 7/1994 | Robinson |
| 5,393,170 | A | 2/1995 | Lochtefeld |
| 5,401,117 | A | 3/1995 | Lochtefeld |
| 5,421,782 | A | 6/1995 | Lochtefeld |
| 5,433,671 | A | 7/1995 | Davis |
| 5,453,054 | A | 9/1995 | Langford |
| 5,482,510 | A | 1/1996 | Ishii |
| 5,528,584 | A | 6/1996 | Grant |
| 5,540,622 | A | 7/1996 | Gold |
| 5,564,859 | A | 10/1996 | Lochtefeld |
| 5,628,584 | A | 5/1997 | Lochtefeld |
| 5,667,445 | A | 9/1997 | Lochtefeld |
| 5,716,282 | A | 2/1998 | Ring |
| 5,735,748 | A | 4/1998 | Meyers |
| 5,738,590 | A | 4/1998 | Lochtefeld |
| 5,756,082 | A | 6/1998 | Lochtefeld |
| 5,779,553 | A | 7/1998 | Langford |
| 5,899,633 | A | 5/1999 | Lochtefeld |
| 6,045,449 | A | 4/2000 | Aragona |
| 6,132,317 | A | 10/2000 | Lochtefeld |
| 6,319,137 | B1 | 11/2001 | Lochtefeld |
| 6,354,955 | B1 | 3/2002 | Stuart |
| 6,357,964 | B1 | 3/2002 | DeGarie |
| 6,450,891 | B1 | 9/2002 | Dubeta |
| 6,485,372 | B2 | 11/2002 | Stuart |
| 6,491,589 | B1 | 12/2002 | Lochtefeld |
| 6,527,646 | B1 | 3/2003 | Briggs |
| 6,716,107 | B2 | 4/2004 | Lochtefeld |
| 6,743,107 | B2 | 6/2004 | Dubeta |
| 6,743,108 | B2 | 6/2004 | Hunter |
| 6,857,964 | B2 | 2/2005 | Hunter |
| 6,939,236 | B2 | 9/2005 | McLaren |
| 7,008,329 | B2 | 3/2006 | Hunter |
| D521,098 | S | 5/2006 | Hunter |
| 7,056,220 | B2 | 6/2006 | Hunter |
| D548,810 | S | 8/2007 | Hunter |
| D567,322 | S | 4/2008 | Hunter |
| D573,222 | S | 7/2008 | Huerta |
| D577,408 | S | 9/2008 | Ketcherside |
| D583,895 | S | 12/2008 | Hlynka |
| 7,713,134 | B2 | 5/2010 | Hunter |
| 7,731,595 | B2 | 6/2010 | Hlynka |
| D619,186 | S | 7/2010 | Strall |
| 7,762,900 | B2 | 7/2010 | Henry |
| 7,775,850 | B2 | 8/2010 | Todokoro |
| 7,780,537 | B2 | 8/2010 | Hlynka |
| 7,887,426 | B2 | 2/2011 | Hlynka |
| 7,967,692 | B2 | 6/2011 | Werner |
| D650,463 | S | 12/2011 | Degirmenci |
| 8,192,291 | B2 | 6/2012 | Brassard |
| 8,197,353 | B2 | 6/2012 | Brassard |
| 8,226,492 | B2 | 7/2012 | Hunter |
| 8,262,494 | B2 | 9/2012 | Hunter |
| 8,430,760 | B2 | 4/2013 | Brassard |
| 8,360,894 | B2 | 11/2013 | Hlynka |
| 8,360,895 | B2 | 11/2013 | Brown |
| 8,579,715 | B2 | 11/2013 | Olive |
| 8,608,581 | B2 | 12/2013 | Hunter |
| D697,159 | S | 1/2014 | Altindag |
| D697,571 | S | 1/2014 | Altindag |
| D705,381 | S | 5/2014 | Brassard |
| D705,882 | S | 5/2014 | Brassard |
| D705,883 | S | 5/2014 | Brassard |
| D706,892 | S | 6/2014 | Altindag |
| 8,784,224 | B1 * | 7/2014 | Schafer ..... A63G 21/18 472/116 |
| 9,079,111 | B2 | 7/2015 | Hunter |
| D771,213 | S | 11/2016 | Ozturk |

(56) References Cited

U.S. PATENT DOCUMENTS

| | | | | |
|---|---|---|---|---|
| D779,010 | S | 2/2017 | Ozturk | |
| 2005/0047869 | A1 | 3/2005 | Lochtefeld | |
| 2005/0075180 | A1 | 4/2005 | Dubeta | |
| 2006/0194638 | A1 | 8/2006 | Hunter | |
| 2008/0153610 | A1 | 6/2008 | Braun | |
| 2009/0062025 | A1 | 3/2009 | Hlynka | |
| 2009/0221377 | A1 | 9/2009 | Hlynka | |
| 2012/0122598 | A1* | 5/2012 | spiroglu | A63G 21/18 472/117 |
| 2012/0277011 | A1* | 11/2012 | Hunter | A63G 21/18 472/88 |
| 2013/0184087 | A1 | 7/2013 | Degirmenci | |
| 2014/0135126 | A1* | 5/2014 | Suzuki | G06F 3/041 463/31 |
| 2015/0314203 | A1 | 11/2015 | Hunter | |
| 2017/0106295 | A1 | 4/2017 | Hunter | |

FOREIGN PATENT DOCUMENTS

| | | | |
|---|---|---|---|
| CA | 2639347 | | 2/2009 |
| CA | 2656749 | | 8/2009 |
| CA | 2951552 | | 12/2015 |
| CN | 101417179 | | 4/2009 |
| CN | 201832417 | | 5/2011 |
| CN | 1279911 | C | 12/2014 |
| EP | 2498884 | | 5/2011 |
| GB | 2224948 | | 5/1990 |
| WO | 200124899 | | 4/2001 |
| WO | 2011057395 | | 5/2011 |
| WO | 2018013063 | | 1/2018 |

* cited by examiner

LOOPING SAUCER AMUSEMENT ATTRACTION AND METHOD FOR MAKING THE SAME

PRIORITY

This application is a National Stage Application entry under Chapter II of the Patent Cooperation Treaty for International Application PCT/IB2018/000761 filed Jun. 8, 2018 and published as WO 2018/224888 A2, which claims priority thereto and to U.S. application Ser. No. 29/625,616, filed Nov. 10, 2017 now U.S. Design Pat. No. D855,136 granted Jul. 30, 2019, and claims priority to U.S. Application No. 62/517,053, filed Jun. 8, 2017, each of which is incorporated by reference in its entirety into this application.

FIELD OF THE INVENTION

The present invention relates to an amusement attraction apparatus and method. More particularly, the present invention relates to a water ride attraction and method whereby riders to travel thereon in a looping travel path.

BACKGROUND

Waterslide attractions typically provide riders with a thrilling experience of speed and lateral force upon the body as the riders slide on the attraction. A stream of water is commonly flowed along a flume from an entrance location to an exit location. A rider slides along the flume due to the stream of water, either with or without a ride vehicle, and experiences excitement as they travel from the entrance location to the exit location along with the flow of water. One type of water ride includes a riding surface in the shape of a bowl that is positioned horizontally upon the ground or other surface, whereby a rider enters the bowl along a side of the bowl and exits via an opening in the bottom of the bowl. For example, a pool of water may be positioned underneath the bowl such that a rider falls through the opening in the bottom of the bowl and splashes into the pool of water below. Water parks and other facilities containing waterslide attractions often must regularly introduce new water rides or in order to maintain customer appeal and interest.

Thus, an improved waterslide that introduces new concepts, features, or slidepaths for a rider is desired. Such an improved waterslide may provide riders with a ride experience that such riders have not encountered before, thereby driving excitement and sales at locations, such as waterparks, which install such a waterslide. The improved waterslide would ideally contain one or more novel slidepaths that a rider would travel while riding upon the waterslide. The improved waterslide would ideally be visually interesting for both bystanders and riders.

SUMMARY

The present invention is related to a method and apparatus relating to a tilted waterslide feature. In one embodiment, a waterslide feature may include a tilted ride surface for supporting a rider thereon, an entrance, connected with the ride surface, for providing a rider onto the ride surface, an exit, connected with the ride surface, for receiving a rider from the ride surface, wherein the ride surface is configured to cause the rider to travel in a looping travel path from the entrance to the exit.

In another embodiment, a method for providing a waterslide feature may include providing a tilted ride surface for supporting a rider thereon, providing an entrance, connected with the ride surface, for a rider to enter onto the ride surface, providing an exit, connected with the ride surface, for a rider to exit from the ride surface, and moving the rider in a looping travel path covering substantially 360 degrees from the entrance to the exit.

DRAWINGS

The features, objects, and advantages of the present invention will become more apparent from the detailed description set forth below when taken in conjunction with the drawings, wherein:

FIG. 4A shows a perspective view' of a waterslide feature having theming and having common features with other water attractions, according to one embodiment of the present invention.

DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
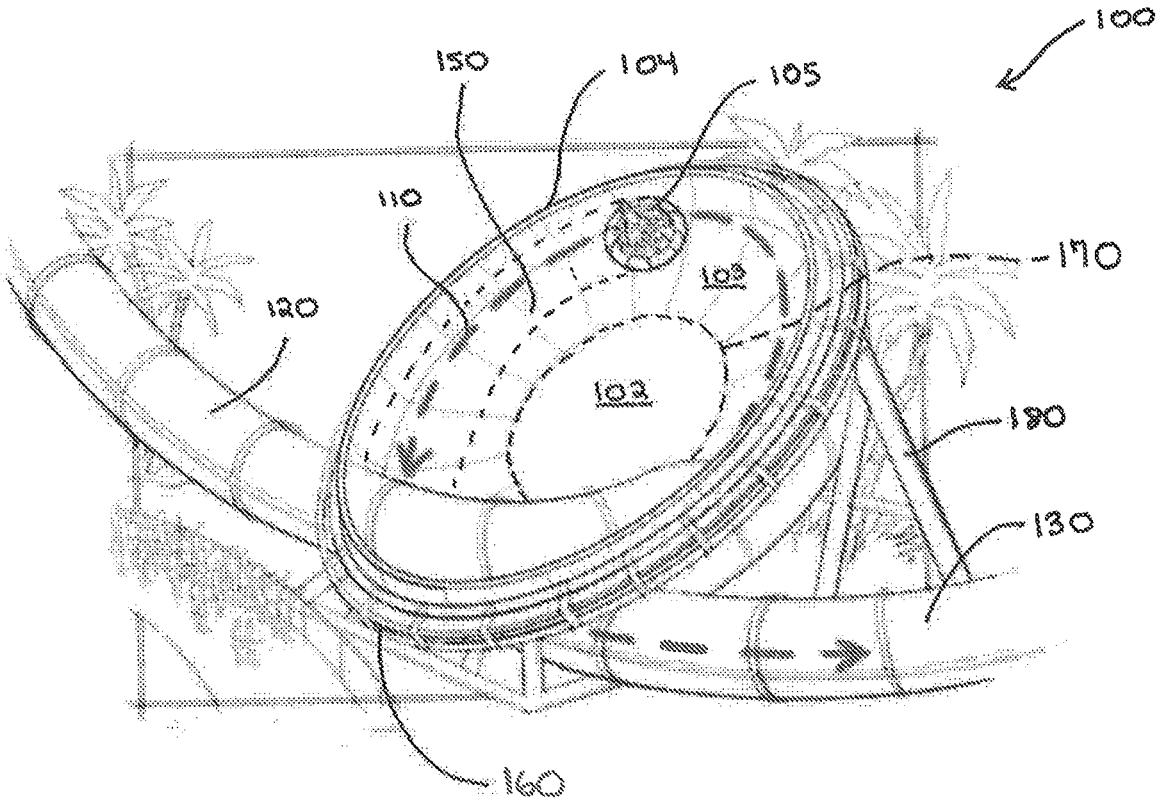
FIG. 1 shows a perspective view of an waterslide feature, according to one embodiment of the present invention.

FIG. 1 shows a waterslide feature 100 and at least one rider 105 riding upon the waterslide feature 100. The at least one rider may ride upon the waterslide feature 100 via a ride vehicle as illustrated (e.g., foam pad, inflatable device, etc.) or may ride upon the waterslide feature 100 without any ride vehicle in alternative embodiments. In one embodiment the waterslide feature 100 may be incorporated within a larger waterslide attraction (e.g., is one sliding feature among others that are encountered by the at least one rider 105 as the at least one rider 105 travels along a full travel path from an initial enhance of the larger waterslide attraction to a final exit of the larger waterslide attraction). In another embodiment, the waterslide feature 100 may be substantially the only feature such that the waterslide feature 100 is the waterslide attraction itself.

For example, as illustrated in FIG. 1, an entrance flume 120 may connect with the waterslide feature 100 in order for the at least one rider 105 traveling along the entrance flume 120 to enter into the waterslide feature 100. Although a flume is shown in FIG. 1, any of a variety of possible entrances may be used in alternative embodiments (open slides, free-falling drops, etc.). If the waterslide feature 100 is incorporated as part of a larger waterslide attraction, the entrance flume 120 may be connected to other, prior waterslide features (e.g. other waterslide features that are the same or similar to waterslide feature 100 to create a sequential travel path through multiple waterslide features 100). In other embodiments, different waterslide features (e.g., corkscrews or any of a variety of other elements) may be used. Similarly, as illustrated in FIG. 1, an exit Hume 130 may connect with the waterslide feature 100 in order for the at least one rider 105 traveling on the waterslide feature 100 to exit from the waterslide feature 100 and travel to an exit for the waterslide or be transported to further elements of the waterslide. Although a flume is shown in FIG. 1, any of a variety of possible exits may be used in alternative embodiments (open slides, vertical drops, etc.). Moreover, although only one entrance and one exit are shown in FIG. 1 and other figures, alternative embodiments may use any of a variety of numbers of entrances and/or exits.

The waterslide feature 100 may be shaped in any of a variety of ways, such as a bowl, a sphere or part of a sphere, or any of a variety of other possible shapes (e.g., shapes having angled walls instead of curved or smooth surfaces). As shown in FIG. 1, the waterslide feature 100 may include a body made up of a flat surface 102 and a curved surface 103 that extends upwardly from the flat surface 102 at the border or perimeter 170 of the surface 102. Although the surface 102 is illustrated as completely flat in FIG. 1, in an alternative embodiment, the surface 102 may be shaped in any of a variety of different shapes (e.g., curved, angled, etc.). Likewise, although the surface 103 is illustrated as curved in FIG. 1, in an alternative embodiment, the surface 103 may be shaped in any of a variety of different shapes (e.g., angled, substantially vertical, etc.). In still other embodiments, there may be no determinable difference or demarcation between surface 102 and 103 such that there is one, smooth ride surface comprising both surface 102 and 103 (e.g., a smooth bowl, sphere, etc.).

A travel path 110 for the at least one rider 105 is shown in FIG. 1 for the waterslide feature 100. In one embodiment, this travel path 110 may extend from an opening of the entrance flume 120, around all or a portion of the surface 103 of the waterslide feature 100, and then into an opening of the exit flume 130. Although an exemplary looping travel path 110 is shown in FIG. 1 is shown whereby the at least one rider 105 only travels along the waterslide feature 100 on the surface 103, in an alternative embodiment, the at least one rider 105 may travel on a travel path that extends across other surfaces (e.g., the surface 102) of the waterslide feature 100. As shown, the waterslide feature 100 consists of a tilted or angled shape (e.g., a tilted bowl or saucer shape), such that the travel path 110 takes a rider from a lowest point 160 of the waterslide feature (e.g., where the entrance flume 120 provides entry into the waterslide feature 100) up and around, in a looping fashion, the one or more surfaces (e.g., surface 102 and/or surface 103) of the waterslide feature 100, back to the lowest point 160 of the waterslide feature 100 (e.g., where the exit flume 130 provides exit from the waterslide feature 100). In this fashion, the travel path 110 may take the rider on a substantially 360-degree looping travel path. For example, the at least one rider 105 may experience a brief feeling of weightlessness at the top (i.e., the apex) of the 360-degree arc along the surface 103. In an alternative embodiment, the travel path 110 of the waterslide feature 100 may vary and form any desired travel path (e.g., less than or greater than 360 degrees). For example, this may be accomplished by altering the positioning of connection of either or both of the entrance flume 120 and/or the exit flume 130 with the waterslide feature 100. In any of the alternative travel paths, a feeling of weightlessness at a top portion of the travel path may still be maintained.

The travel path 110 may be predetermined for the at least one rider 105, for example via the establishment of a guide, channel, or other depression 150 within a surface (e.g., surface 103) of the waterslide feature 100, This guide 150 may be formed, in one embodiment, such that one or more wails or elevated portions (e.g., ridges, hills, bumps, etc.) act to maintain the at least one rider 105 within a particular area of the surface such that the travel path 1.10 is known and/or pre-established for the at least one rider 105. In certain embodiments, the guide 150 may be established via other manners, for example, usage of materials and/or coatings having different coefficients of friction in order to cause the at least one rider 105 to be maintained in a predetermined part of the waterslide feature 100. In such an embodiment, rider enjoyment and/or predictability of ride operation may be better maintained since the positioning of the at least one rider 105 on the waterslide feature 100 is already planned. In an alternative embodiment, the travel path 110 may not be predetermined, allowing for the at least one rider 105 to travel in a variety of travel paths which may differ on a given ride upon the waterslide feature 100 depending upon any of a variety of possible inputs (e.g., rider weight, water velocity, water volume, rider positioning, number of riders, etc.).

The above-described tilted shape (e.g., tilted bowl or tilted saucer) of the waterslide feature 100 may be maintained via a structural framework 180 that includes a plurality of connected beams, poles, posts, or other structural element(s) that are configured to orient the waterslide feature 100 in its tilted, yet stable, configuration. Any of a variety of potential angles of tilt may be used in differing embodiments, such as the substantially 45-degrees of tilt illustrated in FIGS. 1, 3, and others. Other embodiments may include angles of tilt that are less than or greater than the angle of tilt specifically illustrated in the embodiment of FIGS. 1, 3, and others. Although the embodiment of FIG. 1 and others, illustrates the waterslide feature 100 located in close proximity to a ground, in alternative embodiments shown in other figures herein, the waterslide feature 100 may be disposed at any of a variety of elevations (e.g., sunken into the ground and/or elevated higher in the air). The surfaces (e.g., surface 102 and/or surface 103, etc.) of the waterslide feature may be made of any of a variety of materials (e.g., fiberglass, such as colored fiberglass).

Although a specific embodiment has been shown in FIG. 1 for the waterslide feature 100, any of a variety of other possible features or functionality may be included and/or removed from a waterslide feature in other embodiments. For example, although the waterslide feature 100 showcases a tilted bowl configuration with an open top, an alternative embodiment may be a fully enclosed waterslide feature (e.g., a closed saucer, sphere, etc.). Likewise, a waterslide feature may include additional functionality, such as lighting characteristics, that may add to rider or spectator enjoyment For example, lights (e.g., light-emitting diodes) may be connected with and/or implanted within or underneath one or more surfaces (e.g., surface 102 and/or surface 103) of the waterslide feature 100. Such lighting may be configured to illuminate through one or more of the surfaces (e.g., transparent or semi-transparent surfaces) of the waterslide feature 100. For example, lighting may be configured to illuminate in order to visually illustrate the travel path 110 for the at least one rider 105 (e.g., may illuminate prior to, during, and/or after the at least one rider 105 has travelled upon the corresponding surface). Such an illuminated indication of the travel path 110 may be performed with sequential lighting (e.g., a series of lights illuminate sequentially as a rider approaches and/or traverses a surface of the waterslide feature 100) in certain embodiments. Sound and/or tactile features (e.g., vibration, etc.) may additionally be used in certain embodiments of the waterslide feature 100 in addition to, or in replacement of lighting features.

Figure 2A:
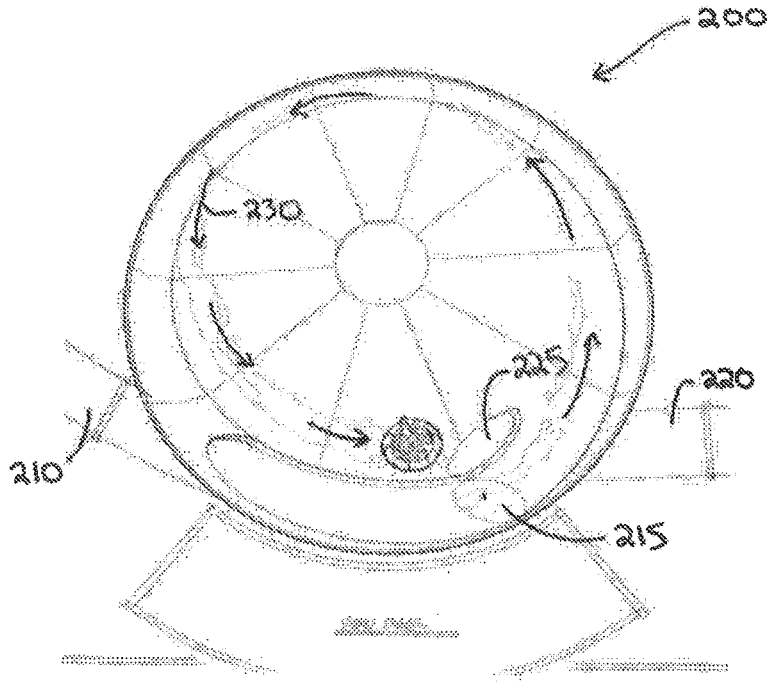
FIG. 2A shows a top-down view of a waterslide feature having a side-by-side entrance/exit configuration, according to one embodiment of the present invention.

FIG. 2A shows a top-down view of a waterslide feature 200 having a side-by-side entrance/exit configuration. Certain features and/or operation of the waterslide feature 200 may be the same or similar to those discussed elsewhere in this application. As shown, an entrance flume 210 delivers riders into the waterslide feature 200 by way of an entrance opening 215. Similarly, an exit flume 220 receives riders from the waterslide feature 200 by way of an exit opening 225. A rider travels along a travel path 230 from the entrance opening 215 to the exit opening 225. The entrance opening 215 and the exit opening 225 are oriented with respect to one another in a side-by-side configuration, whereby the entrance opening 215 and the exit opening 225 are next to or adjacent to one another, but are not overlapping one another (i.e., the entrance flume 210 or entrance opening 215 does not obscure the exit opening 225 when viewed from a top perspective).

Figure 2B:
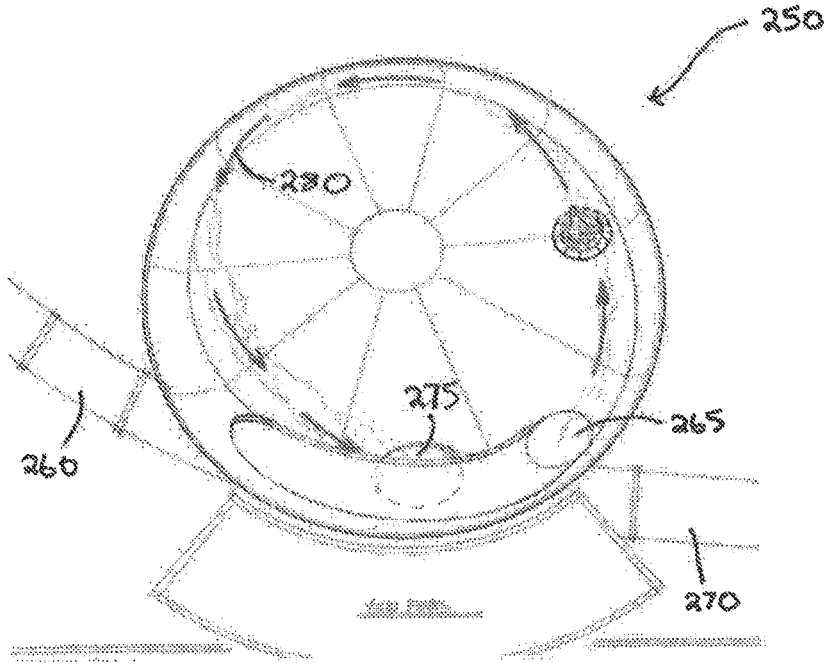
FIG. 2B shows a top-down view of a waterslide feature having an over-under entrance/exit configuration, according to one embodiment of the present invention.

In contrast to FIG. 2A, FIG. 2B shows a top-down view of a waterslide feature 250 having an over-under entrance/exit configuration. Certain features and/or operation of the waterslide feature 250 may be the same or similar to those discussed elsewhere in this application. As shown, an entrance flume 260 delivers riders into the waterslide feature 250 by way of an entrance opening 265. Similarly, an exit flume 270 receives riders from the waterslide feature 250 by way of an exit opening 275. A rider travels along a travel path 280 from the entrance opening 265 to the exit opening 275. The entrance opening 265 and the exit opening 275 are oriented with respect to one another in an over-under configuration, whereby the entrance flume 260 or entrance opening 265 overlaps with and obscures at least a portion of the exit opening 275. Any of a variety of possible configurations between entrance and exit locations or delivery positions may be used in alternative embodiments.

Figure 3:
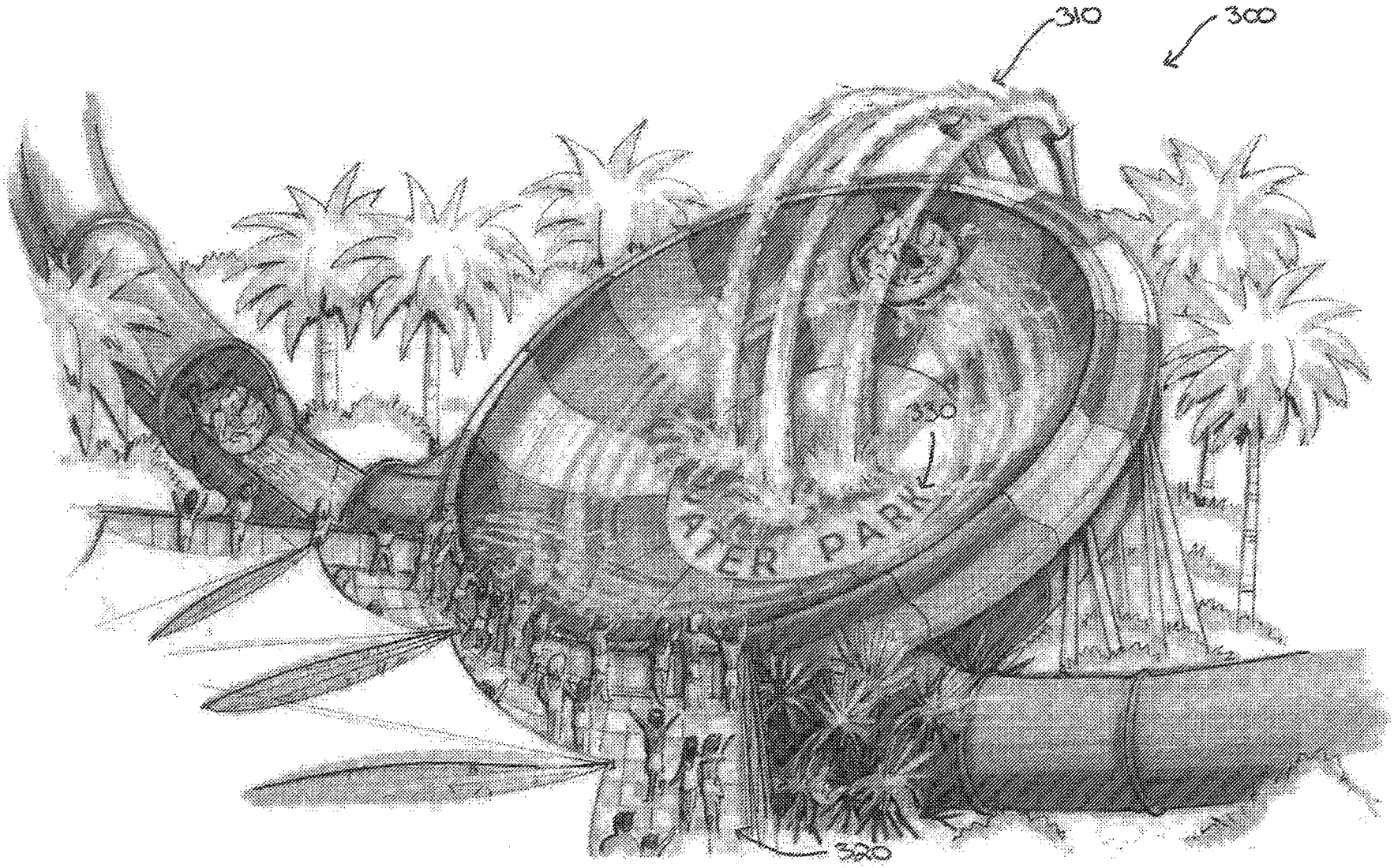
FIG. 3 shows a perspective view of a waterslide feature having an exemplary water spray feature, according to one embodiment of the present invention.
Figure 9H:
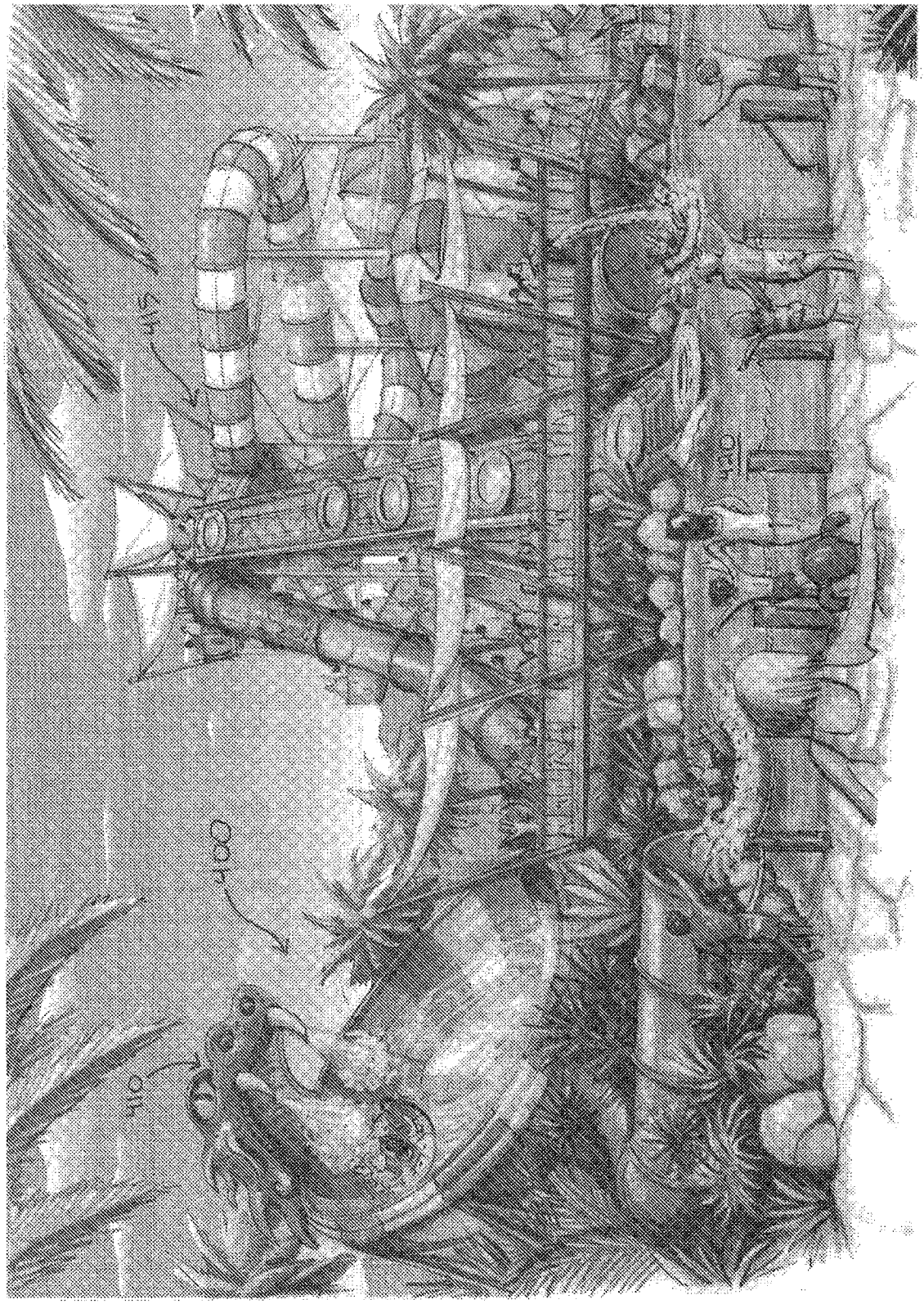
FIG. 9 illustrates a front view of an exemplary embodiment of a waterslide feature according to embodiments described herein.

FIG. 3 shows a perspective view of a waterslide feature 300 having an exemplary water spray feature 310. Certain features and/or operation of the waterslide feature 300 may be the same or similar to those discussed elsewhere in this application. The water spray feature 310 may include one or more conduits (e.g., 5 pipes, etc.) that are configured to spray or otherwise dispose water onto at least a portion of a surface of the waterslide feature 300. This disposal of water may be configured to dump or spray upon riders as they traverse the ride and/or may be used to provide additional waterflow upon the waterslide feature 300 (e.g., to aid in establishing or providing a travel path for riders as they traverse the waterslide feature). Although a specific water spray feature 310 having a particular orientation, positioning, and/or operation is explicitly illustrated in FIG. 3, other embodiments may include a variety of possible water features (e.g., waterfalls, spouts, guns, etc.) as desired. In certain embodiments, a logo, name, or other visual indicia 330 may be provided upon a surface of the waterslide feature 309 (e.g., along a central surface that riders loop around). In certain embodiments, the waterslide feature 300 may be positioned adjacent to a viewing area 320 to allow for greater spectator engagement.

FIG. 4A shows a perspective view of a waterslide feature 400 having theming and having common features with other water attractions. Certain features and/or operation of the waterslide feature 400 may be the same or similar to those discussed elsewhere in this application. As explicitly illustrated in FIG. 4A, a particular theme 410 (e.g., a dragon theme) has been provided for the waterslide feature 400 and includes various additional water spray features (e.g., sprays of water emitting from a jet located within themed "teeth" of a dragon).

Figure 4B:
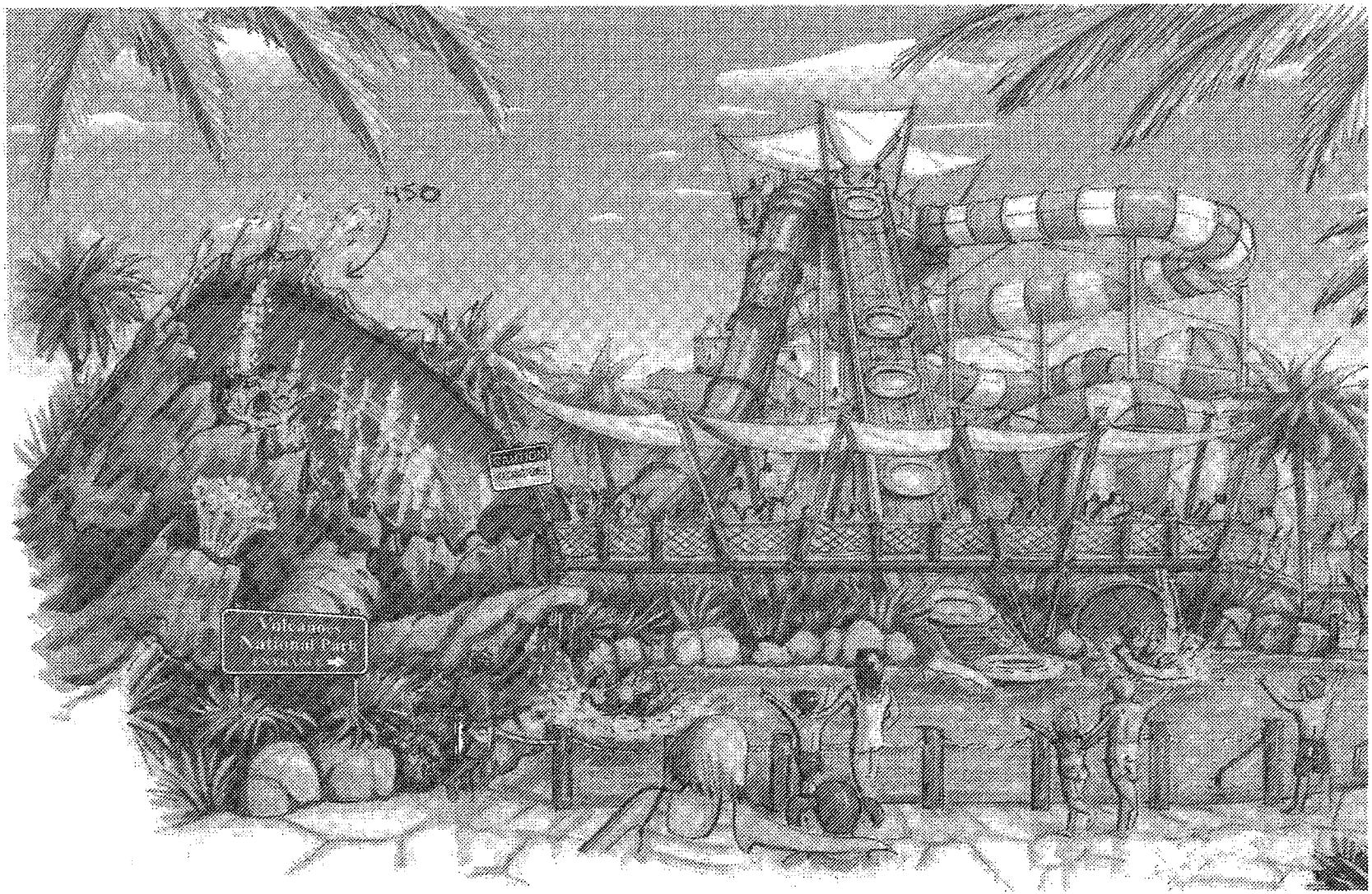
FIG. 4B shows a top-down view of a waterslide feature having theming different, from the theming shown in FIG. 4A, according to one embodiment of the present invention.

In addition, FIG. 4A illustrates that the waterslide feature 400 may be provided in combination with other waterslide attractions, such that the waterslide feature 400 and the other waterslide attraction share common features, such as a splash pool 420 used as a final exiting feature after riders traverse the waterslide feature 490. FIG. 4B similarly shows a perspective view of a waterslide feature 450, but utilizing different theming for the waterslide feature 450 (e.g., a volcanic theme) and includes various additional water spray features (e.g., upward shooting sprays of water from jets located within the riding surface of the waterslide feature 450), Certain features and/or operation of the waterslide feature 450 may be the same or similar to those discussed elsewhere in this application. Indeed, any of a variety of possible theming may be used as desired in alternative embodiments.

Figure 5:
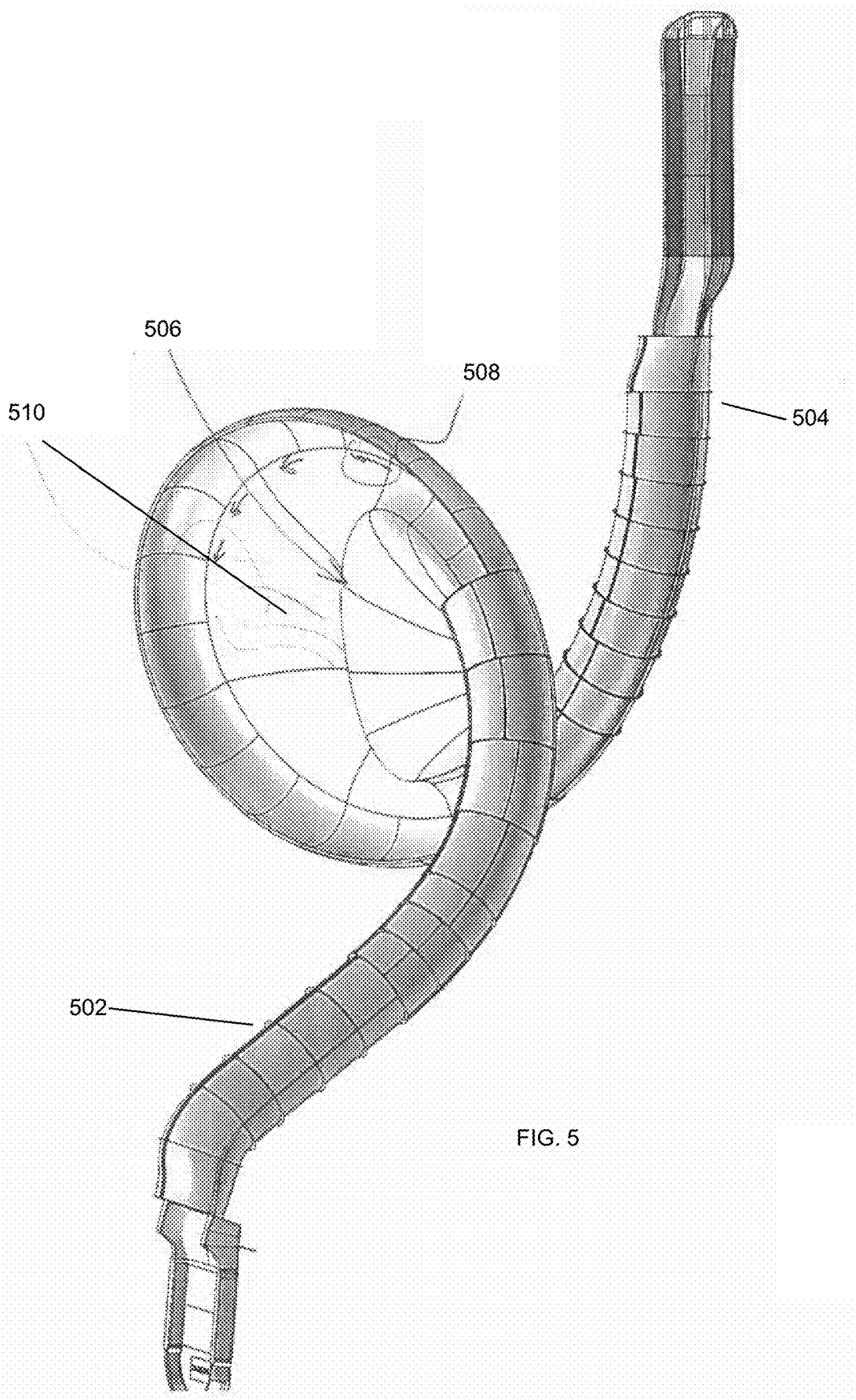
FIG. 5 illustrates an exemplary waterslide feature according to embodiments herein.

FIG. 5 illustrates an exemplary waterslide feature according to embodiments herein. The waterslide feature may be provided in combination with other waterslide attractions and have a entrance flume 502 and exit flume 504. The entrance and exit flumes may be open, partially or fully enclosed, and combinations thereof. The entrance flume 502 may be higher than the exit flume 504. The entrance flume 502 may be on the same level as or even lower than the exit flume 504. In an exemplary embodiment, the waterslide feature may include water jets 508 that are configured to inject water onto the curved surface 510 and/or travel path. The water jets may be used to control a direction of the travel path and/or a speed along the travel path. The water jets may also be used to impart or change rider direction, orientation, and/or rotation. The water jets may be used in conjunction with other ride features, such as textured or interference features to also or additional control a direction, orientation, and/or rotation of the rider on the ride surface.

In an exemplary embodiment, the middle section 506 may be configured to maximize a weight range of riders that may be accommodated on the ride. The middle section 506 may therefore be elevated to create the depression or guide as described herein. The elevation of the middle section may define a shape different than an exterior perimeter of the waterslide feature such that a variable path may be taken by different riders.

Figure 6:
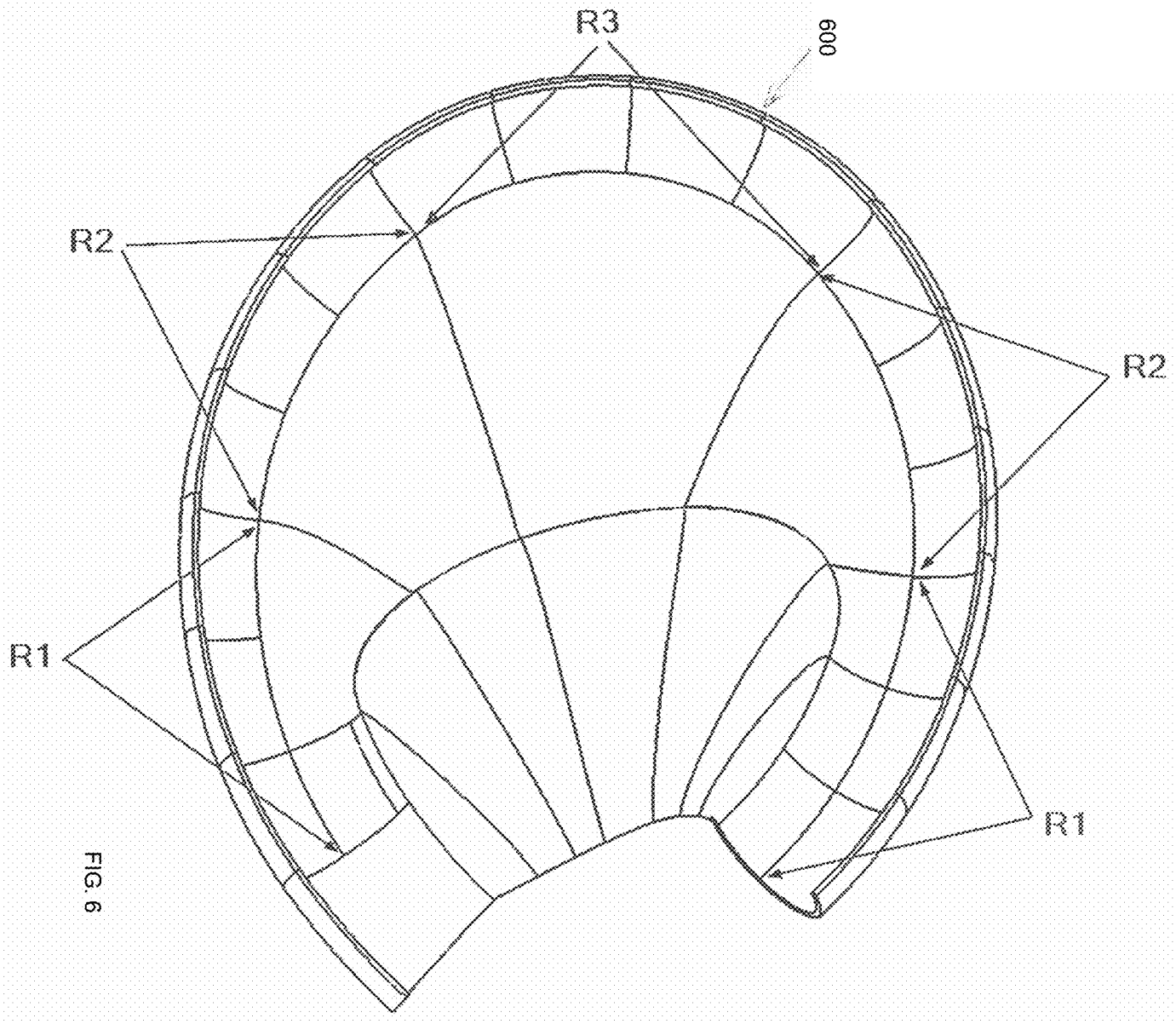
FIG. 6 illustrates an exemplary top view of the waterslide feature of FIG. 5.

FIG. 6 illustrates an exemplary top view of the waterslide feature of FIG. 5. As seen, the waterslide feature may include a middle section 606 adjacent the entrance flume 602 and exit flume 604. The middle section 606 may be elevated with respect to the ride path 610. The outer perimeter may also include an elevated curved wall 612 extending from the ride path 610. The elevated surfaces of the middle section 606 and the outer wall may define a ride path 610 in which a rider may traverse through the waterslide feature. In an exemplary embodiment, a shape of the middle section may be different than a shape of the outer wall, such that a ride path of variable width is defined. As shown, the location of the entrance and exit flume may define a first side of the waterslide feature. The outer wall of the waterslide feature may define an outer boundary of a shape of the waterslide feature. The shape may define a major axis from the side defined by the entrance and exit flume to a side opposite the entrance and exit flume. The middle section may define an outer boundary of a shape for an interior boarder of the travel path. The interior boarder shape may define a separate major axis. The major axis of the interior boarder shape of the middle section may be off axis from the major axis of the shape of the waterslide feature as defined by the outer wall. The configurations of the outer wall shape and the middle section may be to define a rider path having a maximum width on a side of the water slide feature opposite the side defined between the entrance and exit flumes.

In an exemplary embodiment, an outer perimeter of a ride path may define a first shape and an interior perimeter of a ride path may define a second shape. The outer perimeter may be defined by an outer wall. The inner perimeter may be defined by an elevated surface relative to the ride path. The ride path may also be defined by other attributes as described such as variable frictional surfaces, bumps, flanges, boarders, walls, elevated surfaces, depreciated or indented surfaces, and any combination thereof. The ride path at the entrance flume may be a first width. The ride path may thereafter expand to a maximum. The ride path width after the maximum may thereafter reduce to a width at the exit flume. The entrance width may be less than or equal to an exit width.

As seen in FIG. 6, the outer perimeter of the waterslide feature may be defined by a plurality of radii. In an exemplary embodiment, the waterslide feature may have an outer perimeter adjacent the entrance flume and exit flume of a first radius. The waterslide feature may thereafter transition to sections of the outer perimeter of a second radius, and a middle section of the outer perimeter of a third radius. The transitions between radius, may be continuous between sections or may be stepwise discontinuous. The step-wise discontinuity may define different sections of different radius. There may be two, three, four, five, or more sections two radii, three radii, four radii, five radii, or other number. As shown, five sections of constant radii are shown having three different radius. In an exemplary embodiment, the section by the entrance and/or exit flume define a maximum radius. In an exemplary embodiment, the section in the middle between the entrance and exit flume define a minimum diameter. The sections may stepwise or continuously transition between the minimum and maximum radii sections. As shown, R1 is a maximum, R3, is a minimum, and R2 is between R1 and R3. In an exemplary embodiment, the radii of curvatures are set to achieve an approximately constant speed of a rider or raft through the exemplary waterslide feature.

Figure 7:
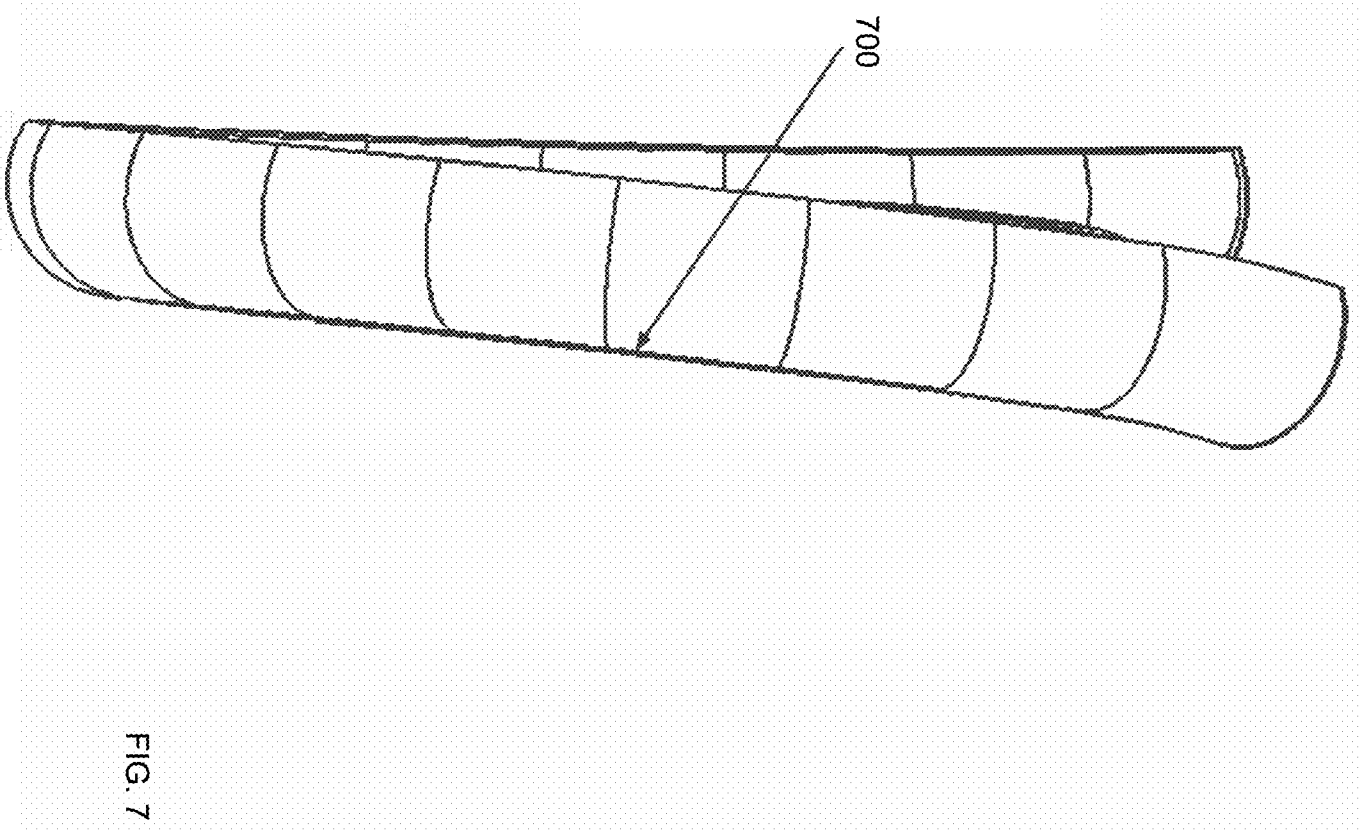
FIG. 7 illustrates an exemplary side profile view of an exemplary embodiment of a waterslide feature according to embodiments described herein.

FIG. 7 illustrates an exemplary side profile view of an exemplary embodiment of a waterslide feature according to embodiments described herein. As shown, the waterslide feature may define a spiral or helical path between the entrance flume and exit flume.

Figure 8:
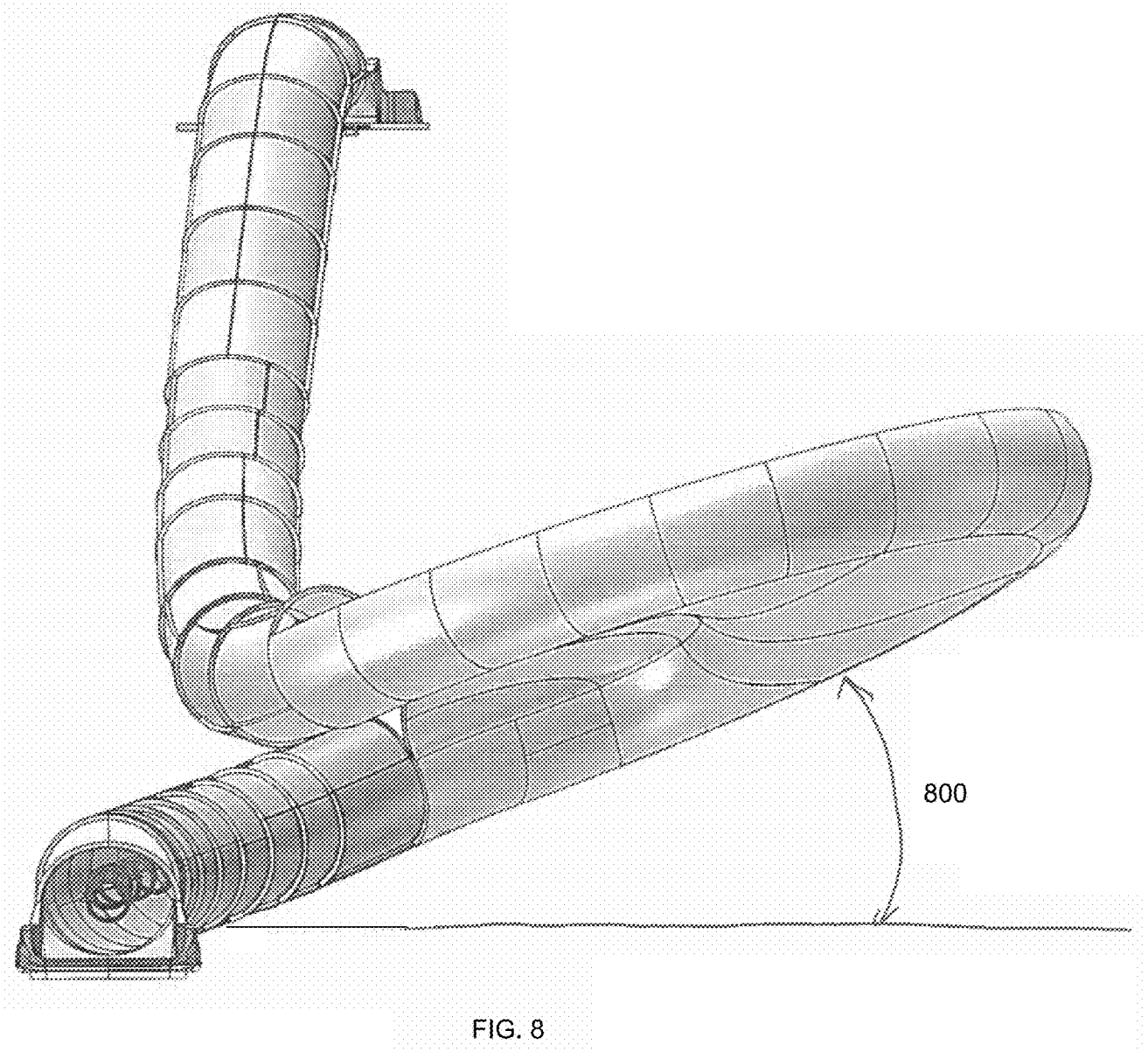
FIG. 8 illustrates an exemplary embodiment of a waterslide feature according to embodiments described herein.

FIG. 8 illustrates an exemplary embodiment of a waterslide feature according to embodiments described herein. FIG. 8 depicts a side view of a water attraction integrating features described herein. As shown, the ride path may be angled relative to a physical horizon. In an exemplary embodiment, the waterslide feature may define a helical or spiral path about a longitudinal axis. In an exemplary embodiment, the longitudinal axis is angled relative to the vertical. In an exemplary embodiment, the angle is approximately 45%. The angle may be less than 45% to vertical. The angle may be more than 45% to vertical.

Figure 9:
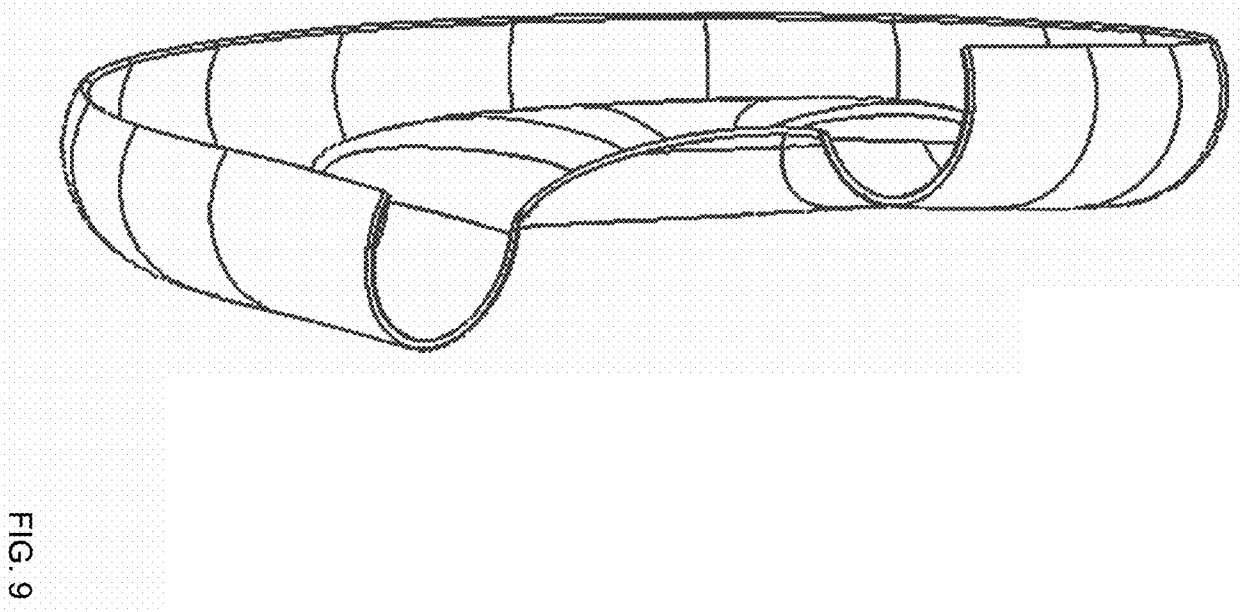
Figure 10:
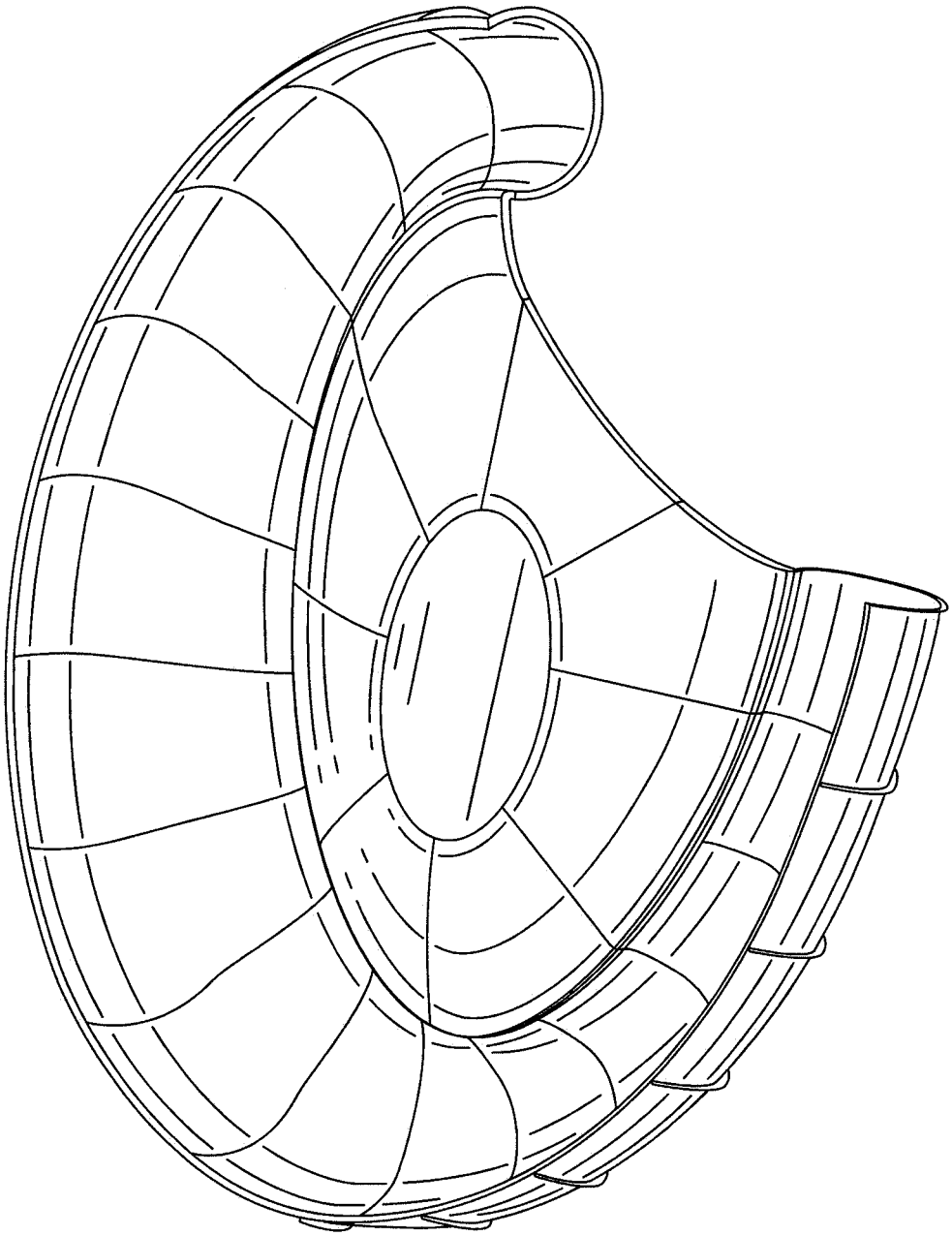
FIG. 10 illustrates an elevated perspective view of an exemplary embodiment of a waterslide feature according to embodiments described herein.
Figure 11:
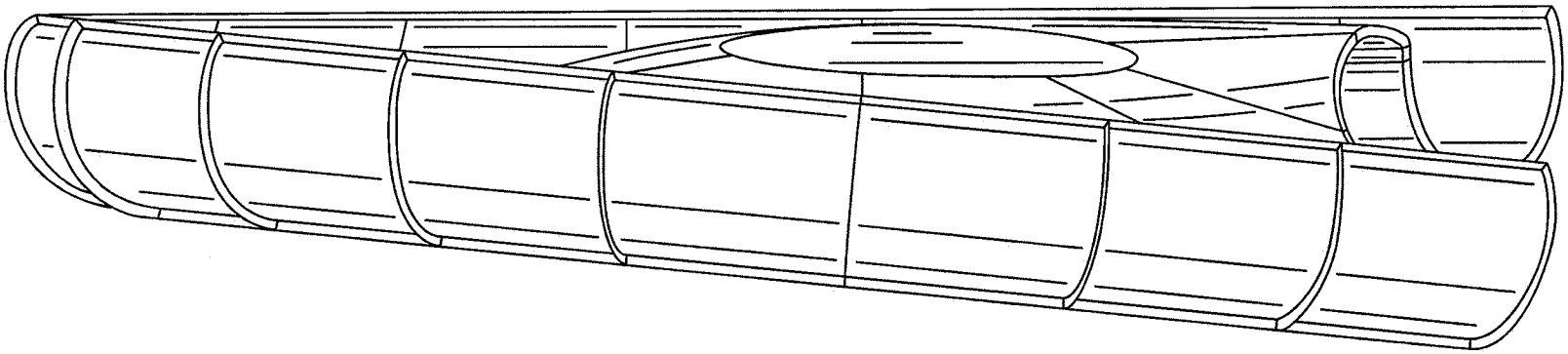
FIG. 11 illustrates a side view of an exemplary embodiment of a waterslide feature according to embodiments described herein.
Figure 12:
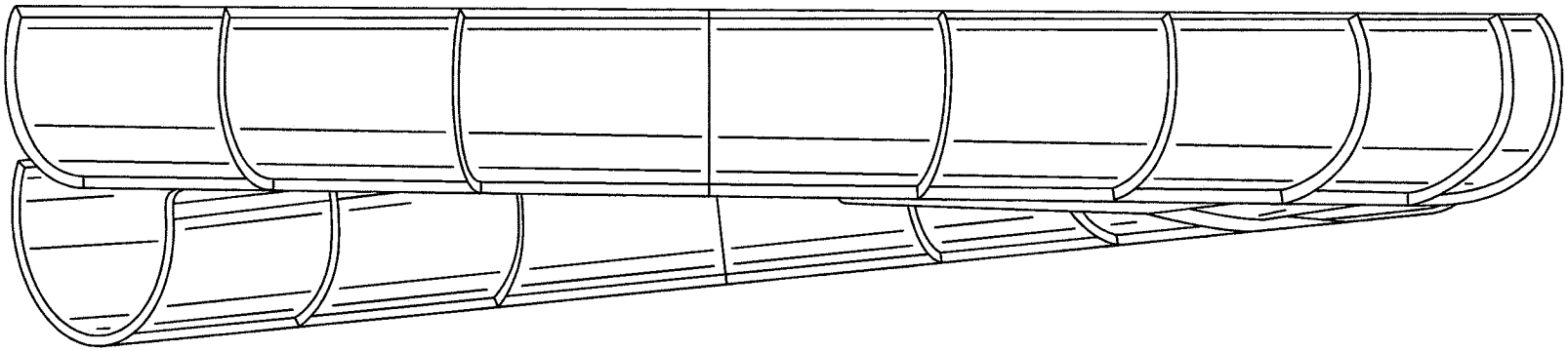
FIG. 12 illustrates a second side view of an exemplary embodiment of a waterslide feature according to embodiments described herein.
Figure 13:
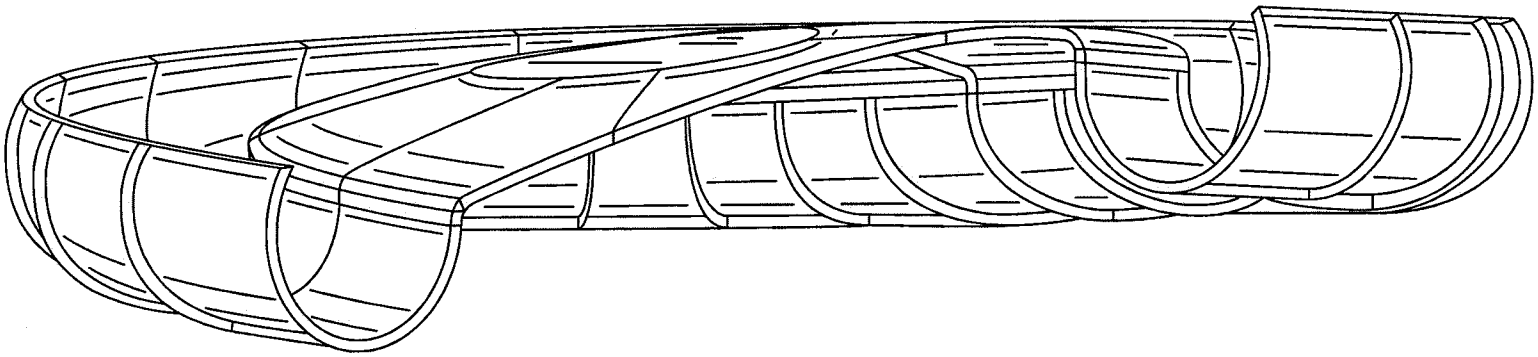
FIG. 13 illustrates an exemplary front view of an exemplary embodiment of a waterslide feature according to embodiments described herein.
Figure 14:
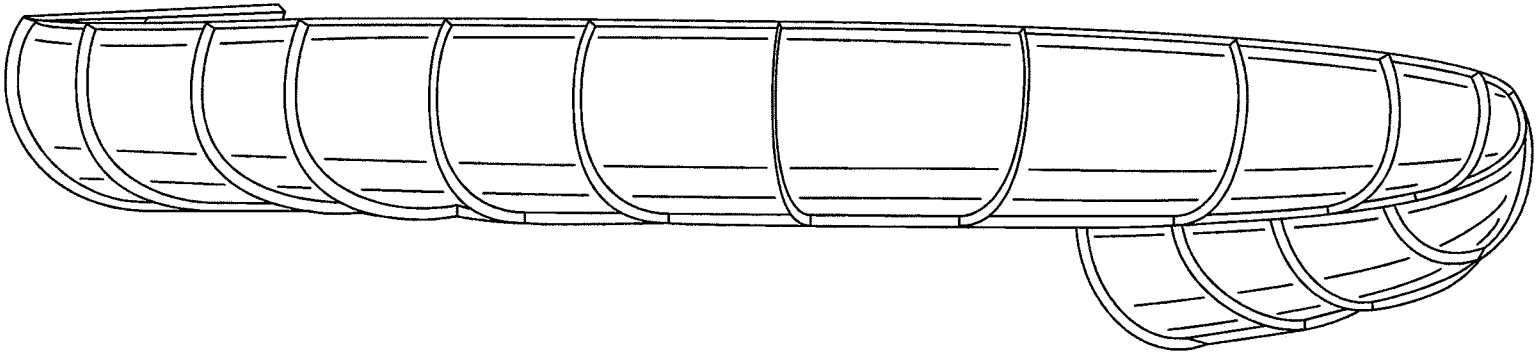
FIG. 14 illustrates a back side view of an exemplary embodiment of a waterslide feature according to embodiments described herein.
Figure 15:
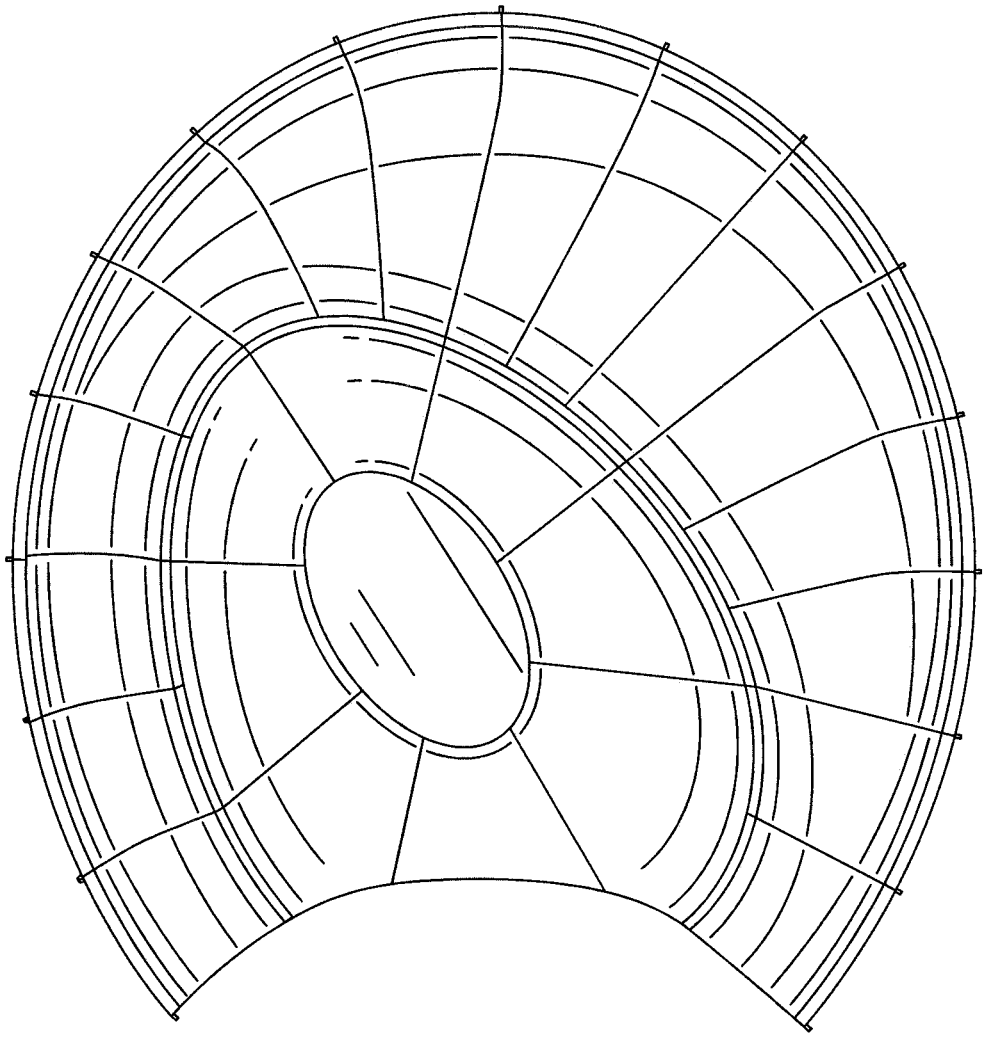
FIG. 15 illustrates a top side view of an exemplary embodiment of a waterslide feature according to embodiments described herein.
Figure 16:
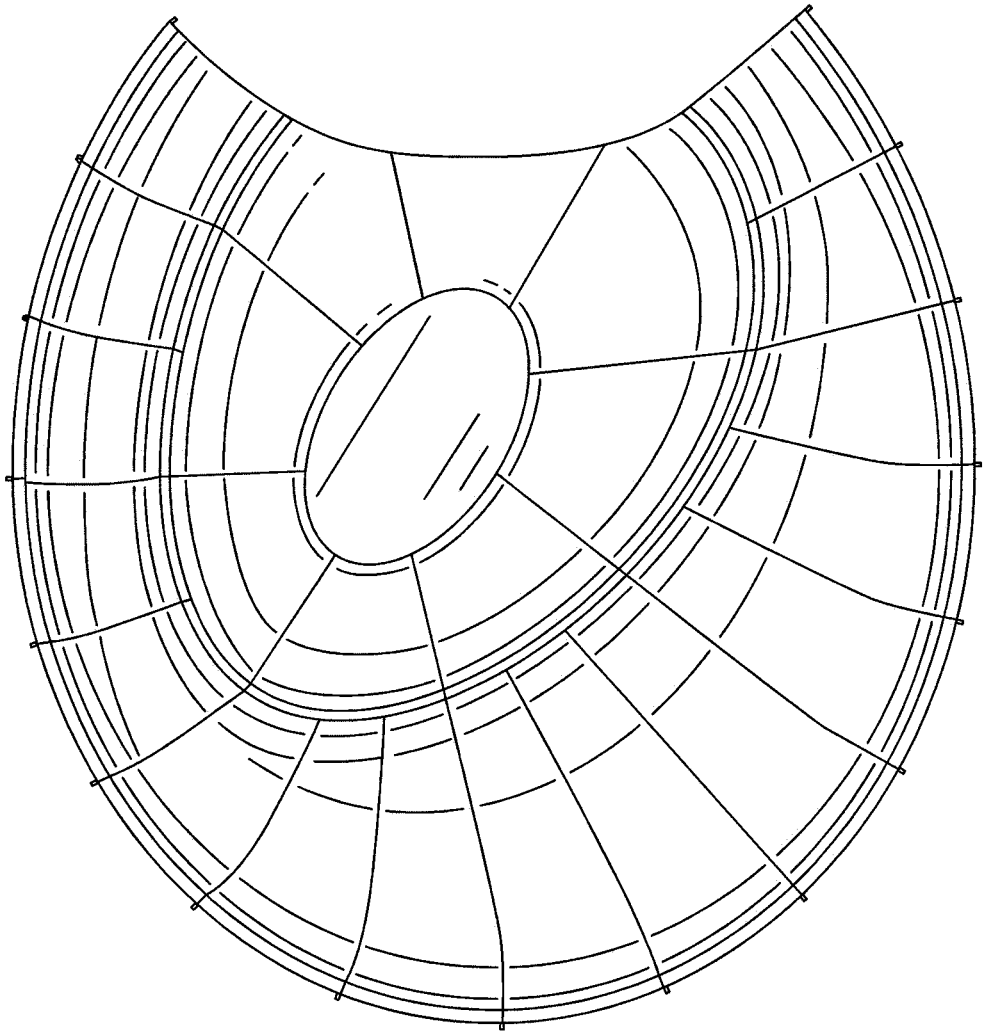
FIG. 16 illustrates a bottom view of an exemplary embodiment of a waterslide feature according to embodiments described herein.

FIG. 9 illustrates a front view of an exemplary embodiment of a waterslide feature according to embodiments described herein. FIG. 10 illustrates an elevated perspective view of an exemplary embodiment of a waterslide feature according to embodiments described herein. FIG. 11 illustrates a side view of an exemplary embodiment of a waterslide feature according to embodiments described herein. FIG. 12 illustrates a second side view of an exemplary embodiment of a waterslide feature according to embodiments described herein. FIG. 13 illustrates an exemplary front view of an exemplary embodiment of a waterslide feature according to embodiments described herein. FIG. 14 illustrates a back side view of an exemplary embodiment of a waterslide feature according to embodiments described herein. FIG. 15 illustrates a top side view of an exemplary embodiment of a waterslide feature according to embodiments described herein. FIG. 16 illustrates a bottom view of an exemplary embodiment of a waterslide feature according to embodiments described herein.

FIG. 15 illustrates an exemplary configuration of a middle section and exterior perimeter to define a ride path of variable width. As shown, the interior middle section may define a generally egg shaped or ovoid elevated section. As shown, the exterior perimeter may define a generally ovoid or egg shaped outer shape. In an exemplary embodiment, the major axis of the middle section and a major axis of the exterior perimeter are not aligned or parallel. In an exemplary embodiment, the major axis of the middle section is approximately 45 degrees to 90 degrees to the major axis of the middle section. FIG. 15 illustrates an outer perimeter defined by a continuously transitioning radius of curvature from a maximum adjacent a flume entrance and/or flume exit to a minimum and back to a maximum.

An exemplary embodiment includes a method for providing a waterslide feature having providing an entrance configured to receive a rider; providing an exit configured to discharge the rider; providing a ride surface that extends between the entrance and exit; and wherein the ride surface is configured to support and cause the rider to travel in a looping travel path from the entrance to the exit.

An exemplary embodiment may include any combination of additional features, including, for example, a flume is provided as at least one of the entrance and the exit; providing the ride surface includes providing the ride surface in the shape of a tilted bowl; providing the entrance and the exit includes connections with the ride surface at substantially the lowest elevation of the ride surface; the providing the ride surface includes the extending the ride surface above the lowest elevation of the ride surface; providing the ride surface includes further providing a guide configured to maintain the rider on a predetermined area of the ride surface as the rider moves along the looping travel path.

An exemplary embodiment includes a waterslide feature including an entrance configured to receive a rider; an exit configured to discharge the rider; and a ride surface extending between the entrance and exit and configured to support and cause the rider to travel in a looping travel path from the entrance to the exit.

An exemplary embodiment includes a waterslide feature having an entrance configured to receive a rider; an exit configured to discharge the rider; a ride surface extending between the entrance and exit and configured to support and cause the rider to travel in a substantially 360-degree looping travel path from the entrance to the exit; and the travel path including a top portion configured to cause the rider to experience weightlessness while moving across the top portion along the travel path.

The waterslide feature may have any combination of additional features such as, for example, at least one of the entrance or the exit is a flume; the ride surface is in the shape of a tilted bowl; the ride surface includes a guide for maintaining the rider on a predetermined area of the ride surface as the rider moves along the looping travel path; the guide is configured with the travel path including at least one of materials and coatings with different coefficients of friction to cause the rider to be maintained in a predetermined area of the ride surface; the entrance and the exit are connected with the ride surface at substantially the lowest elevation of the ride surface; the ride surface extends above the lowest elevation of the ride surface; the top portion is positioned above the lowest elevation of the ride surface; at least one of the entrance or the exit is a flume; the ride surface is in the shape of a tilted bowl; the entrance and the exit are connected with the ride surface at substantially the lowest elevation of the ride surface; the ride surface extends above the lowest elevation of the ride surface; the ride surface includes a guide for maintaining the rider on a predetermined area of the ride surface as the rider moves along the looping travel path; the guide is defined by an interior perimeter and an exterior perimeter, the interior perimeter and exterior perimeter defining a variable width along the length of the guide; the interior perimeter and exterior perimeter are defined by elevated surfaces above a surface defining the guide; the variable width is a minimum at the entrance and an exit; the interior perimeter defines a first ovoid shape exterior perimeter defines a second ovoid shape.

Exemplary embodiments of a waterslide features are described herein. Although described in terms of a water ride attraction and/or water slide, embodiments are not so limited. Exemplary embodiments may be used with water in which a rider goes down a flume and into an embodiment of the waterslide feature according to embodiments described herein on a sheet or layer of water. The rider may ride directly on the water through the flume and/or waterslide feature, or may ride a raft, inflatable, board, or other vehicle or surface. In an exemplary embodiment, the vehicle may support a plurality of riders. Exemplary embodiments may be used without water, and provide an amusement attraction for riding by one or more riders without water.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any other combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps or integers are included. The terms are not to be interpreted to exclude the presence of other features, steps or components.

The invention claimed is:

1. A waterslide feature comprising:

an entrance configured to receive a rider;

an exit configured to discharge the rider;

a non-planar ride surface extending between the entrance and exit and configured to support and cause the rider to travel in a looping travel path from the entrance to the exit;

an exterior wall defining an exterior perimeter of the waterslide feature;

an interior surface having an interior wall defining an interior perimeter from the entrance to an exit and an elevated surface extending between portions of the interior wall, wherein the ride surface between the exterior perimeter and interior surface defines a ride path of variable width from the entrance to the exit, the variable width is created by the portion of the exterior perimeter defining a portion of an exterior ovoid having an exterior major axis and exterior minor axis and the interior surface defining a portion of an interior ovoid having an interior major axis and interior minor axis and the exterior major axis of the exterior ovoid are not aligned with the interior major axis of the interior ovoid.

2. The waterslide feature of claim 1, wherein at least one of the entrance or the exit is a flume.

3. The waterslide feature of claim 1, wherein the the exterior major axis is rotationally offset from the interior major axis by between 45 degrees to 90 degrees.

4. The waterslide feature of claim 1, wherein the entrance and the exit are connected with the ride surface at substantially the lowest elevation of the ride surface.

5. The waterslide feature of claim 4, wherein the ride surface extends above the lowest elevation of the waterslide feature.

6. The waterslide feature of claim 1, wherein the ride surface includes a guide for maintaining the rider on a predetermined area of the ride surface as the rider moves along the looping travel path.

7. The waterslide feature of claim 6, wherein the guide is defined by an interior perimeter and the exterior perimeter, the interior perimeter and exterior perimeter defining a variable width along the length of the guide.

8. The waterslide feature of claim 7, wherein the interior perimeter and exterior perimeter are defined by elevated surfaces above a surface defining the guide.

9. The waterslide feature of claim 8, wherein the variable width is a minimum at the entrance and the exit.

10. The waterslide feature of claim 9, wherein the interior perimeter defines a first ovoid shape and the exterior perimeter defines a second ovoid shape, the first ovoid shape defining a different configuration than the second ovoid shape.

11. A method for providing a waterslide feature comprising:

providing an entrance configured to receive a rider;

providing an exit configured to discharge the rider;

providing a ride surface that extends between the entrance and exit;

providing an exterior wall defining an exterior perimeter of the waterslide feature;

providing an interior surface having an interior wall defining an interior perimeter from the entrance to an exit and an elevated surface extending between portions of the interior wall to enclose a space between the portions of the interior wall; and wherein the ride surface is configured to support and cause the rider to travel in a looping travel path from the entrance to the exit, and wherein the ride surface between the exterior perimeter and interior surface defines a ride path of variable width from the entrance to the exit, the variable width is created by the portion of the outer perimeter defining a portion of an exterior ovoid having an exterior major axis and exterior minor axis and the interior surface defining a portion of an interior ovoid having an interior major axis and interior minor axis and the exterior major axis of the exterior ovoid are rotationally offset with the interior major axis of the interior ovoid.

12. The method of providing the waterslide feature of claim 11, wherein a flume is provided as at least one of the entrance and the exit.

13. The method f providing the waterslide feature of claim 11, wherein providing the ride surface includes providing the ride surface in the shape of a tilted bowl.

14. The method of providing the waterslide feature of claim 11, wherein providing the entrance and the exit includes connections with the ride surface at substantially the lowest elevation of the ride surface.

15. The method of providing the waterslide feature of claim 14, wherein the providing the ride surface includes the extending the ride surface above the lowest elevation of the ride surface.

16. The method of providing the waterslide feature of claim 11, wherein providing the ride surface includes further providing a guide configured to maintain the rider on a predetermined area of the ride surface as the rider moves along the looping travel path.

* * * * *